US005603195A

United States Patent [19]

Cosentino

[11] Patent Number: 5,603,195

[45] Date of Patent: Feb. 18, 1997

[54] METHOD AND APPARATUS FOR LAYING TILE

[76] Inventor: Edward Cosentino, 527 Third Ave., No. 287, New York, N.Y. 10016

[21] Appl. No.: 638,354

[22] Filed: Apr. 26, 1996

[51] Int. Cl.[6] ..... E04F 21/18; E04F 21/20

[52] U.S. Cl. ..... 52/149.11; 52/747.11; 52/DIG. 1; 52/506.05; 52/127.3

[58] Field of Search ..... 52/747.11, 747.1, 52/747.12, 749.11, 749.1, 749.13, DIG. 1, 389–392, 127.5, 127.3, 506.05

[56] References Cited

U.S. PATENT DOCUMENTS

| | | | |
|---|---|---|---|
| 1,745,058 | 1/1930 | Rossi | 52/749.13 X |
| 3,512,325 | 5/1970 | Nichols | 52/127.5 X |
| 4,394,125 | 8/1983 | Gussler | 52/389 X |
| 4,503,654 | 3/1985 | Cosentino . | |
| 4,571,910 | 2/1986 | Cosentino . | |
| 5,417,050 | 5/1995 | Cosentino | 52/391 X |
| 5,465,499 | 11/1995 | La Plante | 52/DIG. 1 |

*Primary Examiner*—Robert Canfield
*Attorney, Agent, or Firm*—Brinks Hofer Gilson & Lione

[57] ABSTRACT

A tile mounting system for mounting tiles of stone or other appropriate material to a wall or other supporting body. The system includes a tile engaging member and an aligning member. The tile engaging member includes three substantially mutually orthogonal portions including a rear face engaging portion adapted to engage the rear faces of adjacent tiles, an extending portion extending beyond and spaced from the front faces of the adjacent tiles and a connecting portion extending between the adjacent tiles and connecting the rear face engaging portion and the extending portion. The aligning member comprises a wedge and includes a slot therein for receiving the connecting portion and is adapted to be slid between the front faces of the tiles and the extending portion of the tile engaging member to align the front faces of the tiles.

11 Claims, 1 Drawing Sheet

METHOD AND APPARATUS FOR LAYING TILE

The present invention relates generally to a tile mounting system; and, more particularly, to a system for mounting tiles of stone or other appropriate material to a wall or other supporting body. More specifically, the present invention relates to a method and apparatus for laying tile with the front faces of adjacent tiles lying in a common plane.

There is substantial interest in the construction industry for prefabricated systems to facilitate the covering of walls, ceilings and other surfaces with marble, ceramic and other natural or artificial stone materials. In this regard, it is known to manufacture such materials in the form of slabs or "tiles" of rectangular or other polygonal shape which can be mounted to a supporting surface one by one to form an array of tiles for covering the surface. Typically, the tiles are affixed to and locked in position on the supporting surface by means which include a bed of cement mortar or other bonding agent which has been initially applied to the supporting surface. When the tiles are affixed to the supporting surface, it is desirable for the front faces of adjoining tiles to lie in a common plane.

Applicant's prior U.S. Pat. No. 4,571,910 discloses an apparatus for laying an array of tiles onto a supporting surface. The apparatus includes a plurality of spacer elements which extend between adjacent tiles in such a manner as to ensure that all the tiles lie in a common plane and that the spacing between adjacent tiles is accurate and uniform throughout the array.

However, in order for the front surfaces of the tiles to lie in a common plane, the back surfaces of the tiles must include a plurality of grooves that are precisely spaced from the front surfaces of the tiles to receive the spacer elements. Cutting such grooves into the tiles increases the time and expense required to prepare the tiles for mounting on the supporting surface.

SUMMARY OF THE INVENTION

The present invention provides a tile mounting system which facilitates the mounting of tiles to a supporting body so that the front faces of adjacent tiles lie in a common plane. The invention provides a simple tool that is economical to manufacture, easy to use, and that accurately and reliably aligns the front faces of adjacent tiles to lie in a common plane.

The present invention provides a mounting system for aligning the faces of adjacent tiles being mounted in a fixed position relative to a supporting body. The system comprises a tile engaging member and an aligning member. The aligning member engages the tile engaging member and the faces of adjacent tiles being aligned. The tile engaging member includes three, preferably mutually orthogonal portions. The three orthogonal portions include a connecting portion disposed between a rear face engaging portion and an extending portion. The aligning member includes a slot for receiving the connecting portion of the tile engaging member.

The invention also provides a method for mounting tiles having front and back faces to a supporting body. The method comprises the steps of providing a tile engaging member having a first portion for engaging the rear faces of adjacent tiles, and positioning an aligning member to engage the front faces of the adjacent tiles and a second portion of the tile engaging member which extends outwardly beyond and is spaced from the front faces of the tiles. The positioning step includes the step of moving the aligning member between the front faces and the second portion of the tile engaging member to align the front faces of the adjacent tiles into a common plane.

According to a presently preferred embodiment, the tile engaging member includes three mutually orthogonal portions including a first rear face engaging portion for engaging the rear faces of adjacent tiles, a second extending portion which extends outwardly beyond and is spaced from the front faces of the tiles and a third connecting portion which connects the first and second portions and extends between the adjacent tiles. The aligning member comprises a wedge having a slot therein for receiving the third connecting portion of the tile engaging member and is movable between the front faces of the tiles and the second extending portion. As the wedge is moved between the second extending portion of the tile engaging member and the front faces of the tiles, the front faces are automatically caused to align with one another in a common plane.

With the present invention, a pair of adjacent tiles can be quickly and easily oriented with their front faces aligned in a common plane. The tool of the present invention is simply in construction and easy to use and can readily accommodate tiles of varying thickness such that only a single tool is required to align different thicknesses of tile.

Additional objects, features and advantages will become apparent to those skilled in the art upon consideration of the following detailed description of a preferred embodiment exemplifying the best mode of carrying out the invention.

BRIEF DESCRIPTION OF THE DRAWINGS

FIG. 1 is a perspective view illustrating a tile engaging member positioned relative to adjacent tiles;

FIG. 2 is a side view, partially in cross-section, of a pair of adjacent tiles illustrating the relative positions of the adjacent tiles, the tile engaging member, and an aligning member; and FIG. 3 is a plan view of the aligning member engaged with the tile engaging member.

DETAILED DESCRIPTION OF THE DRAWINGS

Figure 1:
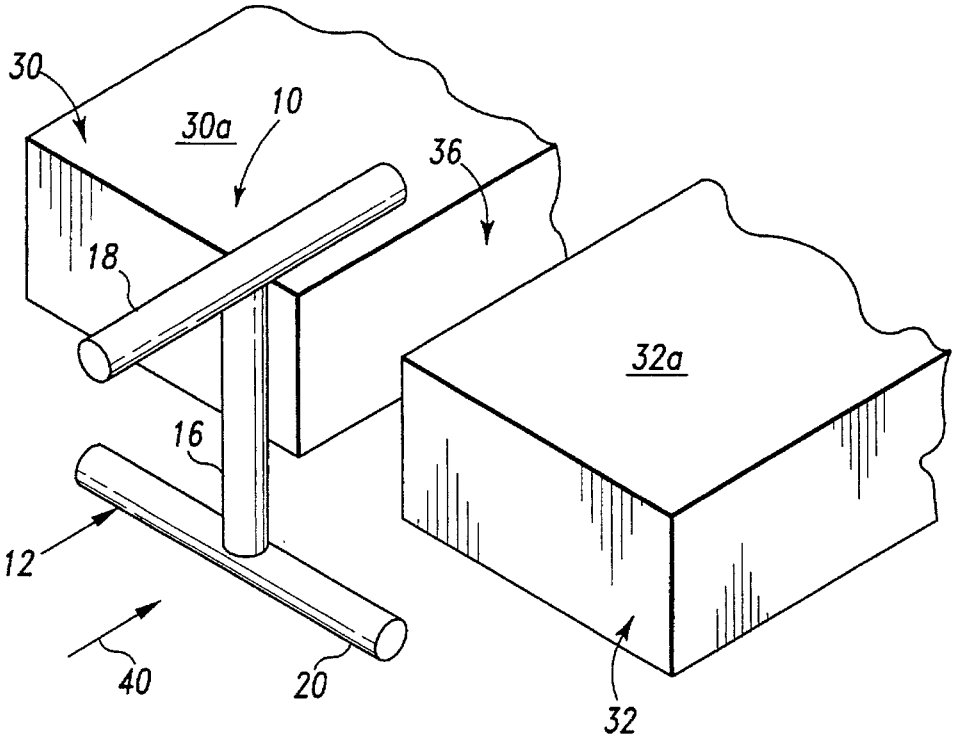
FIGS. 1–3 generally illustrate a tile mounting system according to a presently preferred embodiment of the invention. In the Figures.

The tile mounting system according to a presently preferred embodiment of the invention is generally designated by reference number 10 and includes a tile engaging member 12 and an aligning member 14 which cooperate with each other to align the front faces of adjacent tiles in a common plane. The tile engaging member 12 includes three mutually orthogonal portions including connecting portion 16 disposed between and attached to rear face engaging portion 18 and extending portion 20, respectively. The aligning member 14 includes a wedge 22 formed to include a slot 24 for receiving the connecting portion 16.

The adjacent tiles are positioned against a supporting body (not shown), for example, a wall of a building, and are adapted to be held in position by a layer of cement mortar or other bonding agent so as to have a gap 36 therebetween. The adjacent tiles 30, 32 include front faces 30*a*, 32*a*, and rear faces 30*b*, 32*b*, respectively. The tile engaging member 12 is positioned between the tiles 30, 32 with the rear face engaging portion 20 substantially perpendicular to and extending across and overlapping the gap 36 between the tiles 30, 32 and engaging the rear surfaces 30*b*, 32*b* of the tiles. When the rear face engaging portion 20 is so positioned, the connecting portion 16 extends through the gap 36 between the adjacent tiles and extends outwardly beyond the front faces 30*a*, 32*a* of the tiles such that the extending portion 18 is spaced from the front faces 30*a*, 32*a* of the tiles and is substantially parallel to and aligned with the gap 36.

Figure 2:
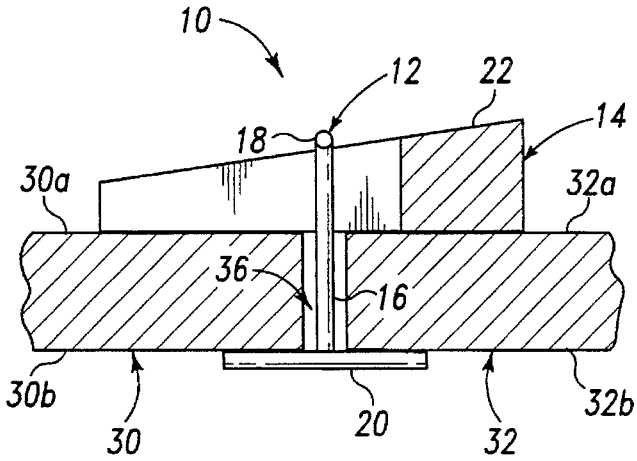
Figure 3:
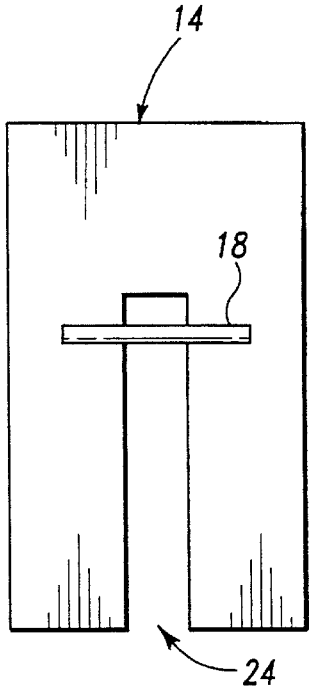

The aligning member 14 is adapted to extend across the gap 36 and is sized and configured to fit between the front faces 30*a*, 32*a* of the tiles and the extending portion 18 of the tile engaging member 12, as shown in FIG. 2. The connecting portion 16 is positioned in the slot 24 with the rear face engaging portion 18 extending across the slot 24, as shown in FIG. 2. As the aligning member 14 is moved from the right to the left, as shown in FIG. 2, the extending portion 18 is moved away from the front faces 30*a*, 32*a*; and as the extending portion 18 is so moved, it pulls the rear face engaging portion 20 with it, which in turn forces the front surfaces 30*a*, 32*a* into contact with the aligning member 14, thereby aligning front surfaces 30*a*, 32*a* in a common plane.

In operation, a pair of adjacent tiles are positioned against a supporting surface with a layer of wet cement mortar or other bonding agent interposed between the supporting surface and the tiles. The front surfaces of the tiles are positioned generally in alignment with a uniform spacing between adjacent tiles. A user then inserts the tile engaging member 12 within the gap 36 between adjacent tiles. This can be done by inserting the member 12 into the gap from the edges of the tiles, i.e., by pushing it in the direction indicated by arrow 40 in FIG. 1; or alternatively, by inserting it from the top of the tiles. Specifically, the tile engaging member 12 is first aligned so that the rear face engaging portion 20 is aligned with the gap 36, and the user then pushes the rear face engaging portion 20 through the gap 36 to a plane just beyond the rear faces 30*b*, 32*b* of the tiles 30, 32. The user rotates the tile engaging portion 12 by 90° so that the rear face engaging portion 20 extends across the gap 36 and engages the rear surfaces 30*b*, 32*b* of the tiles.

After the tile engaging portion is positioned between the tiles, the aligning member is then positioned between the front faces 30*a*, 32*a* of the tiles and the extending portion 18 with the connecting portion 16 disposed within the slot 24. The user pushes the aligning member 14 from right to left, as seen in FIG. 2. As the aligning member 14 moves to the left, it automatically aligns the front faces 30*a*, 32*a* into a common plane. When the front surfaces 30*a*, 32*a* are aligned, the aligning tool 14 can be withdrawn by moving it to the right in FIG. 2. The tile engaging member 12 can then be removed by moving it in the direction opposite to arrow 40 in FIG. 1 or by rotating it by 90° and withdrawing it upwardly through the gap 36. After removal of the tool, the cement mortar is allowed to set to secure the tiles to the supporting body in proper alignment.

With the present invention, accordingly, the front faces of adjacent tiles can be quickly and accurately aligned in a common plane. The tool of the present invention can readily accommodate tiles of differing thickness, necessitating only a single tool for substantially all applications.

Although the invention has been described in detail with reference to a certain preferred embodiment, variations and modifications exist within the scope and spirit of the invention as described and defined in the following claims.

I claim:

1. A tile mounting system for aligning the front faces of tiles being mounted in a fixed position relative to a supporting body, the system comprising:

a tile engaging member including three elongated mutually orthogonal portions; and an aligning member, the aligning member engaging the tile engaging member and the front faces of the tiles.

2. The system of claim 1 wherein the three mutually orthogonal portions includes a rear face engaging portion which engages rear faces of adjacent tiles, an extending portion which extends beyond and is spaced from the front faces of said adjacent tiles, and a connecting portion which extends between said adjacent tiles and connects said rear face engaging portion and said extending portion.

3. The system of claim 2 wherein the aligning member includes a slot for receiving the connecting portion of said tile engaging member.

4. The system of claim 3 wherein the aligning member comprises a wedge movable between said front faces of said adjacent tiles and said extending portion of said tile engaging member for aligning said front faces of said tiles.

5. A system for aligning the faces of adjacent tiles, the system comprising:

a tile engaging member having three, elongated substantially mutually orthogonal portions; and a wedge having a slot for receiving one of the mutually orthogonal portions.

6. The system of claim 5 wherein the wedge includes an upper surface and a lower surface and the slot extends between the upper and lower surfaces.

7. The system of claim 6 wherein the substantially mutually orthogonal portions include an extending portion adapted to extend beyond and be spaced from front faces of adjacent tiles to be aligned, a rear face engaging portion adapted to engage rear faces of the adjacent tiles, and a connecting portion extending between the adjacent tiles and adapted to be received within said slot.

8. The system of claim 7 wherein the connecting portion is operatively received within the slot, the extending portion is operatively positioned adjacent the upper surface of the wedge and the lower surface of the wedge is operatively positioned adjacent the front faces of the adjacent tiles to be aligned.

9. A method for mounting tiles having front and back faces to a supporting body, the method comprising the steps of:

providing a tile engaging member having three elongated mutually orthogonal portions engaging a first portion of the tile engaging member with rear faces of adjacent tiles; and positioning an aligning member to engage the front faces of the adjacent tiles and a second portion of the tile engaging member which extends beyond and is spaced from the front faces of the tiles to align the front faces of said adjacent tiles.

10. The method of claim 9 wherein the positioning step includes the step of moving the aligning member relative to the tile engaging member to move the front faces of the adjacent tiles into a common plane.

11. The method of claim 10 wherein the aligning member comprises a wedge slidable between said second portion of the tile engaging member and the front faces of the adjacent tiles.

* * * * *